United States Patent [19]

Fleissner

[11] 3,991,236

[45] Nov. 9, 1976

[54] METHOD FOR COATING A MATERIAL LENGTH WITH A FLUID COATING SUBSTANCE

[75] Inventor: Hans Fleissner, Egelsbach, Germany

[73] Assignee: Vepa AG, Switzerland

[22] Filed: May 24, 1972

[21] Appl. No.: 256,500

Related U.S. Application Data

[62] Division of Ser. No. 876,881, Nov. 14, 1969, Pat. No. 3,683,648.

[30] Foreign Application Priority Data

| | | |
|---|---|---|
| Nov. 22, 1968 | Germany | 1810361 |
| Apr. 26, 1969 | Germany | 1921499 |
| June 13, 1969 | Germany | 1930115 |

[52] U.S. Cl. ..... 427/315; 118/325; 118/415; 118/DIG. 3; 427/377; 427/420

[51] Int. Cl.[2] ..... B05D 3/02; B05D 1/30

[58] Field of Search ..... 117/119.8, 111, 56, 117/115, 120, 47 R, 55; 68/5 D, 205 R; 118/325, 415, DIG. 3, 44; 8/17, 73, DIG. 15, DIG. 16; 161/66, 67; 222/404, 414, 423; 427/315, 377, 420

[56] References Cited

UNITED STATES PATENTS

| | | | |
|---|---|---|---|
| 1,327,904 | 1/1920 | Carter | 117/56 |
| 1,826,608 | 10/1931 | Ells | 8/17 |
| 2,054,115 | 9/1936 | Abrams et al. | 118/415 |
| 2,060,897 | 11/1936 | Richardson et al. | 118/325 X |
| 2,074,130 | 3/1937 | Penley | 118/314 X |
| 2,299,026 | 10/1942 | Merrill | 118/325 X |
| 2,303,934 | 12/1942 | Heckert | 8/17 UX |
| 2,367,819 | 1/1945 | Carter | 117/56 X |
| 2,565,152 | 8/1951 | Wachter et al. | 117/119.8 X |
| 2,689,196 | 9/1954 | Daniels | 117/119.8 |
| 2,729,536 | 1/1956 | Pall et al. | 68/205 R X |
| 2,974,065 | 3/1961 | Mann et al. | 117/119.8 |
| 3,046,078 | 7/1962 | Salsbury et al. | 117/56 X |
| 3,205,089 | 9/1965 | Kinzelman | 118/DIG. 4 |
| 3,447,884 | 6/1969 | Hasselkass et al. | 8/17 X |
| 3,541,815 | 11/1970 | Appenzeller et al. | 68/200 X |

FOREIGN PATENTS OR APPLICATIONS

| | | | |
|---|---|---|---|
| 754,505 | 3/1967 | Canada | 117/111 |
| 1,086,301 | 10/1967 | United Kingdom | 117/105.3 |

*Primary Examiner*—Michael R. Lusignan
*Assistant Examiner*—Shrive P. Beck
*Attorney, Agent, or Firm*—Craig & Antonelli

[57] ABSTRACT

The present invention is directed to an apparatus for coating a material length with a fluid substance which comprises a coating trough containing the fluid coating substance, a roller means rotatably mounted and adapted to be partially immersed in said fluid coating substance, the surface of the roller means and the edge of the trough defining an aperture for the dispensing of the fluid coating substance, said edge of the trough being provided with a liquid guiding element which extends in the downward direction from said edge and means for conveying the material length to be coated in close proximity to said liquor guiding element.

20 Claims, 5 Drawing Figures

METHOD FOR COATING A MATERIAL LENGTH WITH A FLUID COATING SUBSTANCE

This is a division, of application Ser. No. 876,881 filed Nov. 14, 1969 now U.S. Pat. No. 3,683,648.

BACKGROUND OF THE INVENTION

The present invention relates to a process and apparatus for coating a material length, especially a textile material length, e.g. a tufted carpet, or a plush of natural or synthetic fibers, with a fluid coating substance, e.g. a dyeing liquor. The present invention is also directed to an apparatus for heat-setting and possibly bonding the substance applied.

Apparatus for the continuous coating and further processing of wide lengths of bulky textile materials, e.g. wool and polyamide fibers are well known. In these well known devices the textile materials are submitted to the following consecutive process stages:

1. Application of dyestuffs and auxiliary agents, e.g. by means of a padding or printing unit;
2. a heat-treatment stage, preferably with saturated steam, for fixing the dyestuffs, especially with material penetration during the heating-up process;
3. a washing and rinsing process, preferably with material penetration; and
4. a heat-treatment process, especially a hot air treatment for drying, preferably on at least one sieve drum subjected to a suction draft.

The well known devices are thus principally suited for dyeing and possibly for dyeing and bonding needled felt carpets of any fiber on which the dyestuffs are fixed in a saturated steam atmosphere. However, tufted carpets and other pile material lengths are inadequately dyed on these devices, since pile materials should not be squeezed after the dyestuff application in order to avoid a deformation of the pile. Applicators without subsequent squeezing, which are known up to now, contain many substantial disadvantages. A uniform application over large working widths and an exact metering of the required dyestuff quantities as well as a good dye penetration down to the carpet base are accomplished with great difficulty.

One device for coating a material length with a fluid coating substance is already well known. This device comprises a trough filled with liquid and an overflow edge over which part of the liquor flows into a collecting container. A roller partly immerses in the liquor. The material to be coated is guided over this roller and while passing through the liquor it is wetted. Behind the liquor trough is arranged a doctor operating with air and a stationary stripper which removes part of the liquor adhering to the material length. Such a device can be used for coating, e.g. with a bonding agent or a synthetic resin dispersion. However, it is difficult to apply a dyeing liquor with such a device, since because of the dye affinity of the material to be coated, e.g. the tufted carpet made of a polyamide, the liquor which is stripped from the material contains less dyestuffs than originally. An accurate addition of a corresponding amount of dyestuffs to this liquor is extremely difficult and time-consuming. However, in a continuous operation it is imperative that exactly the same shade is obtained over many treatment hours.

In order to avoid this reduction of the dyestuff content in the dyeing liquor, a device has already been suggested wherein the dyeing liquor is poured onto the material. Such a well known device again comprises a trough in which the fluid coating substance is contained. A roller immerses into the trough and carries along part of the fluid coating substance. To the roller a doctor is correlated with which the dyeing liquor is removed from the rotating roller and passed on to the material to be coated. With such a device it is possible to apply a uniform dye film, e.g. over large widths of 5 m and more, to the material to be coated, e.g. a tufted carpet. However, this device incorporates the disadvantage that the thickness of this dye film is substantially influenced by the viscosity of the fluid coating material (the dyeing liquor) and that a certain thickness cannot be exceeded, even at high speeds of the roller.

Since, particularly in differential dyeing processes, large dye-stuff quantities of up to about 400 to 500% and more, based on the material weight, are to be applied, such a coating device does not meet present needs. (Carpet lengths have generally a weight of 800 g/m$^2$ to 1600 g/m$^2$.) Up to now, the remedy which has been found is that several of such coating devices are arranged one behind the other and a film of the coating substance is poured onto the material several times. Of course, the use of several such coating devices is expensive.

SUMMARY OF THE INVENTION

An object of the present invention is to avoid the prior art disadvantages in the steam-treatment of materials, for example, textile materials.

It is another object of the present invention to improve the well known dyeing processes and apparatus and to provide a device wherein larger quantities of a fluid coating substance can be uniformly applied over large working widths.

A further object of the present invention is to provide an improved process and apparatus wherein thick, bulky textile lengths of natural and synthetic fibers, especially polyacrylonitrile fibers, can be dyed and uniformly fixed.

Other objects and further scope of applicability of the present invention will become apparent from the detailed description given hereinafter; it should be understood, however, that the detailed description and specific examples, while indicating preferred embodiments of the invention, are given by way of illustration only, since various changes and modifications within the spirit and scope of the invention will become apparent to those skilled in the art from this detailed description.

Pursuant to the present invention, it has been found that the above-mentioned disadvantages may be eliminated and a much improved process and apparatus for coating textile material lengths with a fluid coating substance, e.g. a dyeing liquor, may be obtained by providing a device which comprises a trough containing the fluid coating substance with an overflow edge and a rotating roller which immerses into the fluid coating substance. The overflow edge of the trough containing the fluid coating substance is connected with a liquor guiding element which is inclined or arranged almost vertical and which extends up to the material length to be coated. The liquor level lies beneath or at the same level with the overflow edge, and the liquor is passed over the overflow edge on to the liquor guiding element by the rotation of the roller and/or by means of the pump which supplies the liquor to the trough.

In a further embodiment of the present invention, and to avoid turbulence in the trough, it is suggested to arrange, in front of the trough, a filling trough of the same width which is provided with a supply pipe for re-filling the coating substance and which has an overflow edge which is arranged above the dyeing liquor level in the trough. According to another feature of the present invention the filling trough is subdivided into two parts by means of a partition, and the supply pipe leads into that part of the trough which is most distant from the overflow edge of the filling trough.

According to the present invention the front wall of the filling trough is inserted into the trough, whereas the side and rear walls of the filling trough are formed by the trough itself, so that the filling trough is a component of the trough.

According to another embodiment of the present invention the filling trough is arranged as a separate unit outside of the trough. Furthermore, all overflow edges are chamfered (canted) towards the appertaining walls at an acute angle and the chamfered strips immerse in the dyeing liquor therebelow. In a further feature of the present invention a sheet partition is inserted between the front wall of the filling trough and the coating roller and in parallel to the coating roller, said sheet partition being inclined similar to the chamfering of the wall of the adjacent filling trough. The sheet wall is furthermore arranged at a distance from the botton of the trough and its upper edge extends beyond the liquor level in the trough. With such a feeding device a uniform supply of the dyeing liquor over the width of the material length, without any turbulence, is obtained. Such a device offers the advantage that even large quantities and thus a very thick film of a fluid substance, e.g. a dyeing liquor, can be uniformly applied onto a material length which is guided beneath the liquor guiding part. The liquor quantity which is applied can be controlled in an effective manner by changing the speed of rotation of the roller.

In order to relieve the operators' attention which is particularly required when the material length is passed at a non-uniform speed through the device, the speeds of the dye application roller and the pump for re-filling the liquor into the trough depend, according to the present invention, on the conveying speed of the material length, and an electrical scanning device provided for keeping the liquor level constant. For this purpose the speed of the material length and/or the speed of the appertaining conveying roller is measured by means of a tachometer generator. The generated voltage coordinates, via a control, the drive of the pump and that of the coating roller. The scanning device consists of an inductive indicator. The induced voltage of this indicator is amplified and also varies, with the aid of a control means and the speed of the coating roller. The dyeing liquor quantity which is conveyed is measured by means of an inductive flowmeter. The induced voltage of this flowmeter influences, via a control, the pump drive. The various control assemblies superimpose similarly as other well known control processes and devices.

Depending on the quality of the carpet to be dyed and the dyeing method, varying liquor quantities (in liters, per square meter of the carpet) are required. The desired dyeing liquor quantities which are to be applied per unit area can be set by a potentiometer. According to the present invention the nominal voltage for a certain conveying speed is varied by means of the potentiometer, i.e. the dyeing liquor quantity in $l/m^2$ of carpet desired for the respective material quality is set in this way. If very large quantities of the coating substance are to be applied, it is advantageous to correlate to the roller a stripping device above the overflow edge so that also the coating substance adhering to the roller is removed and passed to the liquor guiding element.

Furthermore, it is suggested to arrange the roller in the trough in such a way that it is adjustable, in order to render it possible to adjust the slit between the roller and the overflow edge to the same width over its entire length or to vary its width. By adjusting the slit, a premetering of the liquor quantity to be poured onto the material length is possible. By the rotation of the roller, a slight excess pressure on to the liquor is produced which ensures a uniform passage of the liquor over the overflow edge. The liquor motion is furthermore favored by the capillary forces which become effective in the duct between the discharge roller and the trough wall (13 in FIG. 1), which duct narrows up to the overflow edge. The exact metering of the overflow quantity can be controlled by the speed of the roller. For this purpose it is necessary to provide the rollers with an infinitely variable drive means.

As a stripping device a stripping blade can be used which is swivel mounted and forced against the roller by spring action. However, it is also possible to provide a doctor operating with air instead of or in addition to a stripping element.

Tests have indicated that it is of advantage if a roller for guiding the material length is arranged beneath the liquor guiding element. This roller must be arranged exactly in parallel to the overflow edge. If, e.g., a textile material, e.g. a tufted carpet, is involved and if the material is guided over a roller, the surface of the textile material is opened and the coating substance applied can better penetrate into the material. The roller should have as small a diameter as possible in order to obtain as good an opening in the material as possible. In order to avoid a deflection of the roller, even with large working widths, a supporting roller of larger diameter may be provided underneath this roller.

Tests have shown that the capacity of absorption of the material to be coated, e.g. of a tufted carpet or a needled felt can be substantially increased and equalized, if steam is sprayed against the carpet directly before it is coated. The steam should be sprayed against that side of the material which will not be coated. To realize this feature of the present invention it is suggested to correlate a steaming unit to the apparatus. This steaming unit may consist of, e.g., a steaming box or at least a steam spray pipe. The steam jet should be strong enough to penetrate the textile material so that the air between the fibers is expelled and replaced by water steam which substantially favors the subsequent liquor absorption. If the steam is blown against the reverse side of the material this offers the advantage that the textile material, e.g. the tufted carpet or a plush material is further opened by the steam jet and further that the condensate which deposits on the cold material and water droplets which are possibly carried along from the steaming box do not negatively affect the coating. If the steam is blown against the upper side of the material, a water film will form on this side and the undesirable frosting effect on plush and tufted carpets will result. This danger is completely avoided if the steam is blown against the reverse side of the material.

Generally, it is essential that the device is not only useful for a pre-determined working width but that two or three different working widths are possible. For carpets the preferred working widths are 5m, 3m and 2m. In order to render the device suitable for any working width it is suggested to cover the slit between the overflow box and the roller, so that the respective working width can be obtained and to provide the liquor guiding element with limiting bars which can be adjusted to the respective working width.

For further processing material lengths of large widths, especially tufted carpets and plush fibers on which the dyestuffs fix in a steam atmosphere, e.g. wool, polyamides and polyacrylonitrile fibers, a steaming device is set up behind the dyestuff applicator. A steaming device in which the dyestuffs are fixed by means of superheated steam in the heating-up zone and by means of saturated steam or slightly super-heated steam in the dwelling zone is already well known. This well known steaming device is provided with transport rollers for the unilateral material guidance, a heated sump for the generation of saturated steam, a heating unit for superheating the saturated steam which is generated in the sump, a heated inlet roller and a vacuum extraction unit for removing the steam-air mixture which possibly forms at the inlet. For sealing the discharge end, this device is provided with a water lock in which the material is deflected around a roller immersed in the liquid with the upper side in contact with the roller.

It has been found that the pile of pile carpets of polyacrylonitrile and similar fibers with a low softening point is very sensitive to pressure after having been passed through the steamer atmosphere and as long as the material is approximately heated to the fixation temperature. When passing the water seal the pile threads entangle and grow rigid at the same time. In addition there is the danger that the pile is compressed while the material is deflected around the roller in the water seal. The pile deformation resulting from these stresses cannot be completely removed which of course reduces the sales value of the finished product considerably. To eliminate these disadvantages, according to the present invention, it is suggested to provide the well known steaming device with an outlet at the level of the driven transport roller and to arrange a deflector roll or roller outside the steamer in such a way that only the reverse side of the material comes into contact with the roller. Expediently, a suction unit for straightening out the pile is correlated to the outlet and subsequently a cooling zone is arranged at the reverse side of the material. For cooling, it is most advantageous to blow cooling air against the reverse side of the material.

An especially advantageous design results if a sieve drum which is subjected to an excess pressure by means of at least one fan is used for cooling. For deflecting the material at the feed side of this sieve drum, the suction pipe of the vacuum extraction unit which, at the same time serves for straightening the pile, can be used. The side of the sieve drum which is not covered by the material being treated is screened in a well known way by means of a segmentally shaped baffle.

The deflection of the material at the discharge side of the sieve drum can be effected by means of a roller or a drum with the pile side in contact with the roller or drum because, at this stage, the material has been cooled down to such a degree that a permanent pile deformation is definitely avoided. Instead of a blower drum also one or several jet boxes and the correlated fans with drive may be designed in the same way as with the common tenter frames.

Solvent dyeing has gained increasing importance. In accordance with the present invention it is therefore suggested to design the device in such a way that solvent dyeing is also possible. In accordance with the present invention it has been found that this is achieved in an effective way if the steamer is provided with an exhaust opening at or near its bottom. This exhaust opening may then be connected to a solvent recovery plant. The solvent recovery plant may be set up in a separate room, e.g. one floor below. Also, it is of advantage to connect the usual steam extraction units at the inlet and at the discharge end of the steaming device to the solvent recovery plant. For applying the solvent dyeing liquor, the dyestuff applicator may be used. The dyestuff fixation takes place in the steamer in a solvent vapor-steam atmosphere. At the discharge end of the steamer the solvent can be completely flashed off by means of superheated steam with which the material is jetted. However, the solvent can also be removed by passing the material through the water seal and by heating the liquid in the water seal almost to the boiling temperature. In this process the solvent is substantially evaporated and, since it is heavier than the steam, it is collected at the bottom of the steamer from where it may be sucked off and passed to the recovery plant. The part of the solvent which remains in the water of the water seal may be removed by means of a water separator or a centrifuge. In order to avoid that too much solvent is collected in the water seal, part of the water is continually circulated through the centrifuge or the water separator so that the solvent is continually removed from the liquid. The solvent as well as the water can then be re-used.

BRIEF DESCRIPTION OF THE DRAWINGS

The present invention will be more fully understood by reference to the following detailed description of the specific embodiments thereof taken in conjunction with the drawings wherein.

DESCRIPTION OF THE PREFERRED EMBODIMENTS

Figure 1:
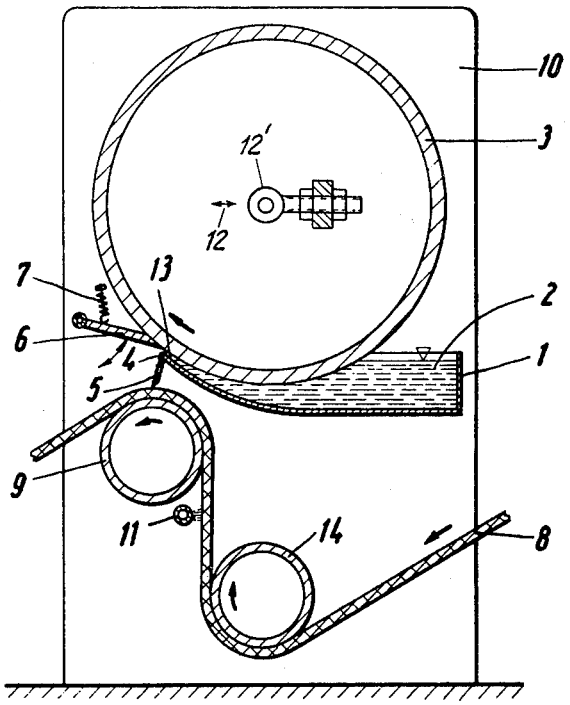
FIG. 1 is a dyeing device according to the present invention.

Referring now to the drawings the dyeing device according to FIG. 1 comprises a trough 1 which contains a fluid coating substance 2. A rotating roller 3 is immersed in the fluid coating substance 2, which can be, e.g., a dyeing liquor. The trough 1 has an overflow edge 4, and behind that edge a liquor guiding part 5. As a stripping unit a stripping blade 6 is provided above the overflow edge 4, said stripping blade being swivel mounted and forced against the roller 3 by means of springs 7. For guiding a material length 8 to be coated another roller 9 is provided, said roller being associated with the liquor guiding part 5 and the overflow edge 4. The trough 1 as well as the rollers 3 and 9 are supported at both sides in stands 10.

For steaming the material length 8 a steam spray pipe 11 is provided. As shown by arrows 12, the roller 3 can be adjusted horizontally, so that a slit 13 between the overflow edge 4 and the roller 3 can be set to its optimum width. Instead of providing the roller 3 as the adjustable element, it is also possible to arrange the trough 1 in such a way that it can be moved.

In front of the steam spray pipe 11 - seen in the direction of material passage, another guide roller 14 is provided. This guide roller can also possibly be arranged at the reverse side of the material. The roller 9 is provided with a drive. In order to prevent the material from slipping, this roller may be provided with an adhesive coating or with pins.

Figure 2:
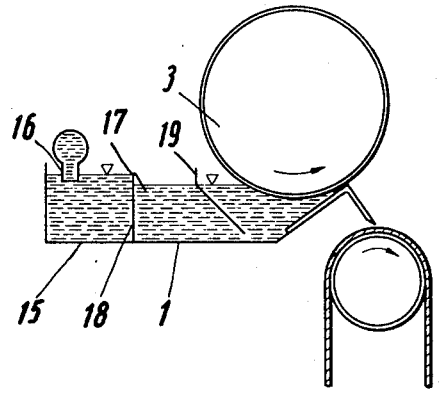
FIGS. 2 and 3 are further embodiments of the dyeing device according to the present invention.

In the embodiment of the dyeing device according to FIG. 2, in the trough 1 a filling trough 15 of the same width is arranged into which a supply pipe 16 communicates, which serves for re-filling the coating substance, e.g. the dyeing liquor. The filling trough 15 has, at the side at which the coating roller 3 is arranged, an overflow edge 17 which is arranged at a higher level than the dyeing liquor level in the trough 1. The overflow edge 17 is chamfered in an acute angle towards the appertaining wall 18 and immerses in the dyeing liquor of the trough 1. Between and in parallel to the wall 18 and the coating roller 3 a sheet partition 19 is arranged in the trough 1 which sheet partition is inclined in a similar way as the adjacent chamfering of wall 18. The lower edge of the sheet partition 19 does not reach the bottom of trough 1 and the upper edge extends beyond the liquor level of trough 1.

Figure 3:
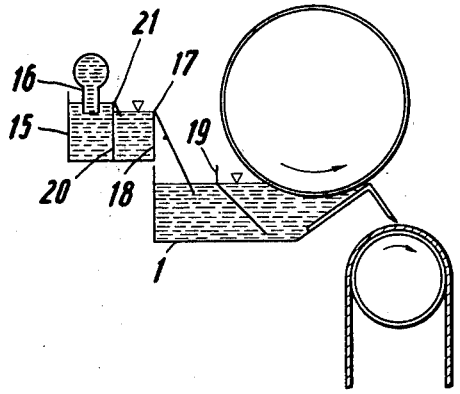

FIG. 3 shows an embodiment of the invention wherein the filling trough is located outside the trough 1. The filling trough 15 is arranged above trough 1 and has an overflow edge 17 which is canted (chamfered) at an acute angle towards the appertaining wall 18 and thus immerses in the liquor in trough 1. In the filling trough 15 an intermediate partition 20 is provided which subdivides the filling trough 15 into two portions. The intermediate partition 20 has an overflow edge 21 with a chamfering which also immerses in the dyeing liquor therebelow. The supply pipe 16 communicates with the portion of the filling trough which is most distant from the overflow edge 17.

Figure 4:
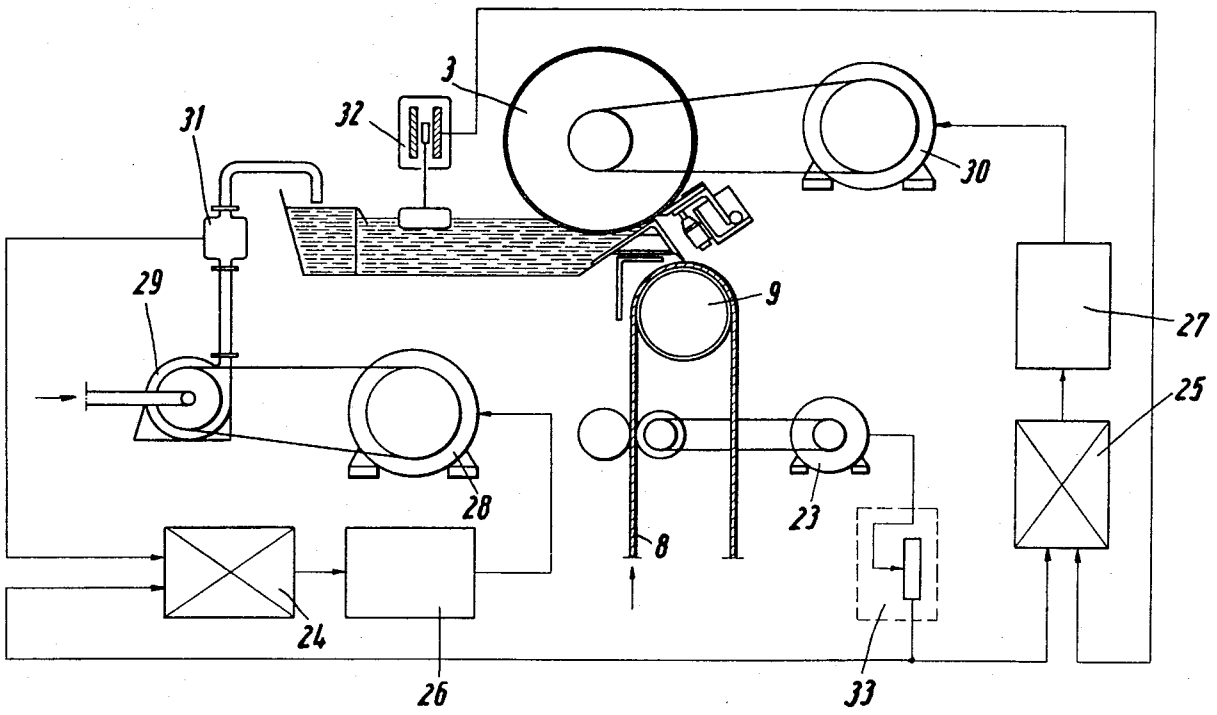
FIG. 4 is a control unit for controlling the dyestuff application.

The wiring diagram of a control unit according to the present invention is shown by means of an example in FIG. 4. A material length 8 is conveyed in the direction of the arrow by means of a drive which is not shown. It actuated a tachometer generator 23, the induced voltage of which influences a drive 28 of a pump 29 and a drive 30 of the coating roller 3 via respective controls 24 and 25 and thyristor units 26 and 27. The dyeing liquor quantity conveyed by the pump is measured independent of its viscosity by means of an inductive flowmeter 31. The voltage generated by the flowmeter is fed as a repeating signal to the control circuit for the pump. In the same way the liquor level is scanned by means of an inductive indicator 32, the induced voltage of which is applied to the control circuit of the drive for the coating roller 3. By means of a potentiometer 33 the nominal voltage for a certain conveying speed is varied, i.e., the dyeing liquor quantity in $l/m^2$ of carpet desired for the respective carpet quality is determined in this manner.

The control units operate fully automatically and ensure the desired uniform application of the treatment agent. These units are of particular importance if the operating speeds of the preceding or subsequently installed other treatment devices vary.

Figure 5:
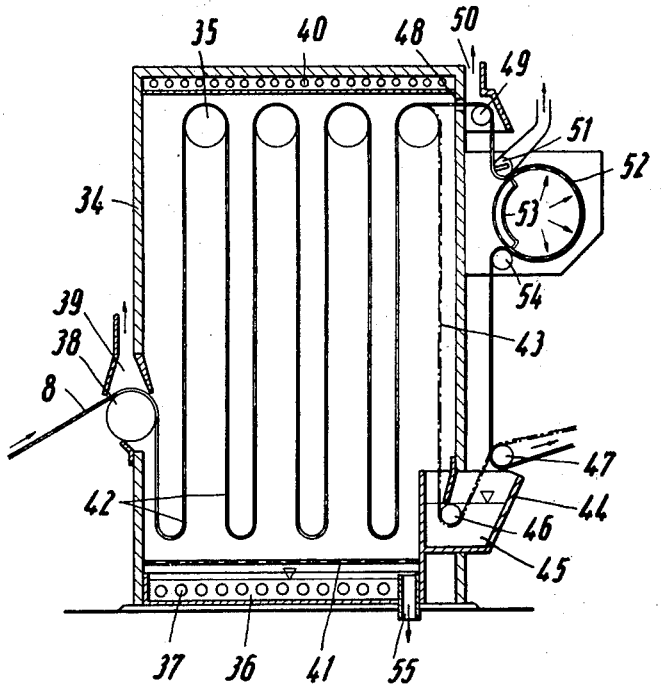
FIG. 5 is a steaming device.

FIG. 5 shows a longitudinal section of one embodiment of a steaming device according to the present invention. The steaming device has a heat-insulated housing 34, transport rollers 35 for the unilateral material guidance, a heated sump 36 containing heating units 37 for the generation of saturated steam, an inlet roller 38 which can be heated, and a vacuum extraction hood 39 associated with the inlet roller 38 at the intake. Additional heating units 40 serve for maintaining the desired temperature, and a sieve bottom 41 is provided to retain water droplets which otherwise might be carried along by the rising steam and come in contact with the material being treated, thereby causing stains.

The material 8 is passed over a heated inlet roller 38 into the steamer where, with the arrangement of the transport rollers 35 is shown, material loops 42 are formed. After having been conveyed through the steamer, the material being treated, e.g., wool or a polyamide, is guided over a distance 43 (shown by dash-dot line) to a water seal 44 in which the material length is deflected around a roller 46 which is immersed in a liquid 45. It is then passed over a roll 47 for further processing. Certain material, e.g. polyacrylonitrile fibers, which is very sensitive to pressure as long as it is heated close to the fixation temperature, is passed through an outlet 48 which can be closed to a deflector roll 49 above which an extraction hood 50 is arranged. A suction pipe 51 effects a straightening of the pile and a deflection of the material on to a sieve drum 52 subjected to an excess pressure. The portion of the sieve drum which is not covered with material being treated is screened by means of a baffle 53 in the well known manner. Over the deflector rolls 54 and 47 the material is conveyed on to further processing.

For solvent dyeing process the extraction units 39 and 50 as well as exhaust socket 55 may be connected to a solvent recovery plant.

The invention being thus described, it will be obvious that the same may be varied in many ways. Such variations are not to be regarded as a departure from the spirit and scope of the invention, and all such modifications as would be apparent to one skilled in the art are intended to be included.

What is claimed is:

1. A method for uniformly coating a textile material length with a liquid coating substance which comprises partially immersing a coating roller in a liquid coating substance disposed in a trough and dispensing said liquid coating substance through a narrow aperture defined by a curved surface of said coating roller and an overflow edge of the trough directly onto a planar liquid guiding element extending downwardly from said edge to a lower edge, flowing the liquid coating substance down over said guiding element and said lower edge, conveying the textile material length immediately below said lower edge, and coating the textile material length by flowing the liquid coating substance directly from said lower edge onto said textile material.

2. The method of claim 1 wherein the coated material is subsequently conveyed through a steaming chamber in loops.

3. The method of claim 1, wherein a small part of said coating roller is immersed within said liquid coating substance, and said coating roller is rotated towards the edge of said trough in order to dispense the liquid coating substance through said aperture.

4. The method of claim 3, which further comprises maintaining the level of the liquid coating substance closely adjacent to the edge of said trough and rotating said roller means upwards immediately in front of the edge of said trough.

5. The method of claim 1, wherein the other side of said textile material has a pile surface and said textile material length is conveyed over a roller positioned immediately below said guiding element and parallel to said overflow edge to cause the pile surface of the side of the textile material length to be coated to open thereby enabling better penetration of the liquid coating substance into said textile material length.

6. The method of claim 5, wherein steam is applied to one side of said material length directly prior to coating the material length with a liquid coating substance on the other side.

7. A method for uniformly coating a textile material length with a liquid substance which comprises partially immersing a coating roller means in a liquid coating substance contained within a trough, said trough having an edge which defines a slit closely adjacent to a curved surface of said coating roller means, rotating the immersed portion of said roller means towards said edge to effect dispensing of the liquid coating substance through said slit, a liquid guiding means including a planar liquid guiding element extending downwardly from said slit, conveying the material length to be coated closely adjacent to a lower edge of said guiding element and coating said material with the liquid substance dispensed through said slit by flowing the liquid substance directly from said slit down said guiding element directly onto said textile material length.

8. The method of claim 7, further comprising the step of directing steam onto one side of said textile material length immediately before coating the other side of said textile material with said liquid coating substance.

9. A method of claim 8, wherein the other side of said textile material has a pile surface and said textile material is conveyed over a roller positioned immediately below said liquid guiding means and parallel to said edge of said trough to cause the pile surface on the side of the textile material length to be coated to open thereby enabling better penetration of the liquid coating substance into said textile material length.

10. A method of uniformly coating a tufted carpet length with a dyeing liquor contained in a trough with a cylindrical roller being partially immersed in the dyeing liquor within said trough and said trough having an edge spaced from a cylindrical surface of the roller to define a slit therebetween, and a liquor guiding means extending downwardly from the edge of said trough, which comprises dispensing said dyeing liquor through said slit directly onto said liquor guiding means, flowing the dyeing liquor down said liquor guiding means, conveying the tufted carpet below and immediately adjacent to said liquor guiding means and coating the dyeing liquor onto one side of said tufted carpet length by flowing the dyeing liquor directly from said liquid guiding means onto said tufted carpet length.

11. The method of claim 10, wherein said tufted carpet is conveyed over a roller positioned immediately below said liquid guiding means and parallel to said edge of said trough to cause the surface of the side of the material to be coated to open thereby enabling better penetration of the dyeing liquor into said carpet.

12. The method of claim 11, which further comprises directing steam onto said tufted carpet length directly before coating with said dyeing liquor, said steam being directed only against said side of said tufted carpet length which is not coated.

13. The method of claim 11, wherein said liquid guiding means includes a substantially vertical flat liquor guiding element having a lower edge positioned in close proximity to said tufted carpet.

14. A method of uniformly coating a textile material length with a liquid coating substance which comprises maintaining a level of a liquid coating substance within a trough having an overflow edge, a liquid guiding means including a planar liquid guiding element extending downwardly from said edge, and means having a surface immersed within and extending downwardly in the liquid coating substance positioned closely adjacent to said overflow edge for defining a slit between said edge and said surface of said means, dispensing said liquid coating substance through said slit directly onto said guiding element, flowing the liquid coating substance down said guiding element, conveying the textile material length below and immediately adjacent to a lower edge of said guiding element and coating the liquid coating substance onto said textile material length by flowing said liquid coating substance directly onto said textile material length.

15. The method of claim 14, wherein maintaining of said level of liquid coating substance and dispensing of said liquid coating substance from said trough are effected by controlling the supply of the liquid coating substance to said trough.

16. The method of claim 14, wherein said textile material is a tufted carpet and said liquid coating substance is a dyeing liquor.

17. The method of claim 16, wherein said tufted carpet is conveyed on a roller positioned immediately below said liquid guiding means and parallel to said overflow edge to cause the surface of the side of the carpet to be coated to thereby open thereby enabling better penetration of the dyeing liquor into said carpet.

18. The method of claim 17, which further comprises directing steam onto said tufted carpet length immediately before coating with said dyeing liquor, said steam being directed only against that side of said tufted carpet length which is not coated whereby the tufted carpet is further opened prior to application of said dyeing liquor.

19. A method of uniformly coating a tufted carpet with a dyeing liquor contained in a trough with a cylindrical coating roller being partially immersed in the dyeing liquor within said trough and said trough having an overflow edge spaced from a cylindrical surface of the coating roller to define a slit therebetween, a substantially vertical planar liquor guiding element extending from said overflow edge downwardly and a guide roller positioned immediately below said guiding element and parallel to said overflow edge for conveying the tufted carpet, which comprises dispensing said dyeing liquor through said slit directly onto said guiding element, flowing the dyeing liquor down said guiding element, conveying the tufted carpet below and immediately adjacent to said guiding element, over said guide roller to cause the side of the surface of the tufted carpet to be coated to open thereby enabling better penetration of the dyeing liquor into said carpet and coating the dyeing liquor onto said opened surface of said carpet by flowing the dyeing liquor directly from said guiding element onto said tufted carpet.

20. The method of claim 19, which further comprises directing steam onto said tufted carpet directly before coating with said dyeing liquor, said steam being directed only against the side of said tufted carpet which is not coated.

* * * * *